United States Patent [19]

Emanual

[11] 4,251,124

[45] Feb. 17, 1981

[54] TELESCOPING CLOSET

[76] Inventor: Everett Emanual, 1408 S. Washington, Compton, Calif. 90221

[21] Appl. No.: 41,016

[22] Filed: May 21, 1979

[51] Int. Cl.[3] ..... A47F 5/08; A47G 5/00

[52] U.S. Cl. ..... 312/4; 160/330; 211/94.5; 312/297

[58] Field of Search ..... 312/321, 323, 246, 310, 312/297, 4; 160/330, 126; 190/15 R, 14; 211/94, 94.5

[56] References Cited

U.S. PATENT DOCUMENTS

| | | | |
|---|---|---|---|
| 834,595 | 10/1906 | Wadsworth | 312/321 |
| 844,447 | 2/1907 | Gautier | 211/94 |
| 962,227 | 6/1910 | Kuersten | 211/94 |
| 995,805 | 6/1911 | Perry | 211/94.5 |
| 1,014,020 | 1/1912 | Miller | 211/94 |
| 1,227,705 | 5/1917 | Ulrich | 312/310 |

FOREIGN PATENT DOCUMENTS

| | | | |
|---|---|---|---|
| 160395 | 3/1933 | Switzerland | 312/4 |

*Primary Examiner*—Alexander Grosz

*Attorney, Agent, or Firm*—Fulwider, Patton, Rieber, Lee & Utecht

[57] ABSTRACT

An enclosed hanging wardrobe is suspended from elevated supports within the confines of a cubicle having walls on either side and an open face. The hanging wardrobe can be reciprocally drawn out of the cubicle in cantilevered suspension. The hanging wardrobe has fabric drapes which can be drawn by means by a cord and pulley system operated by a crank. With the drapes drawn open, a carrier can be reciprocally drawn forward in the hanging wardrobe and a clothes rack suspended therefrom is reciprocally movable along the carriage tracks projecting forward from the underside of the carrier.

8 Claims, 7 Drawing Figures

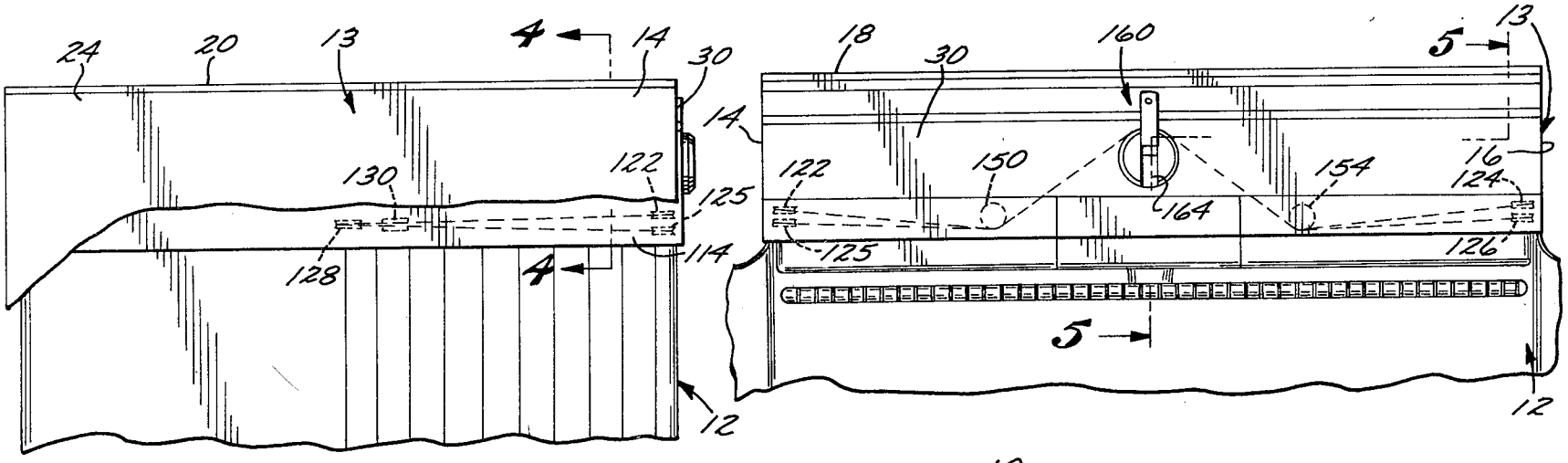
FIG. 3
FIG. 1
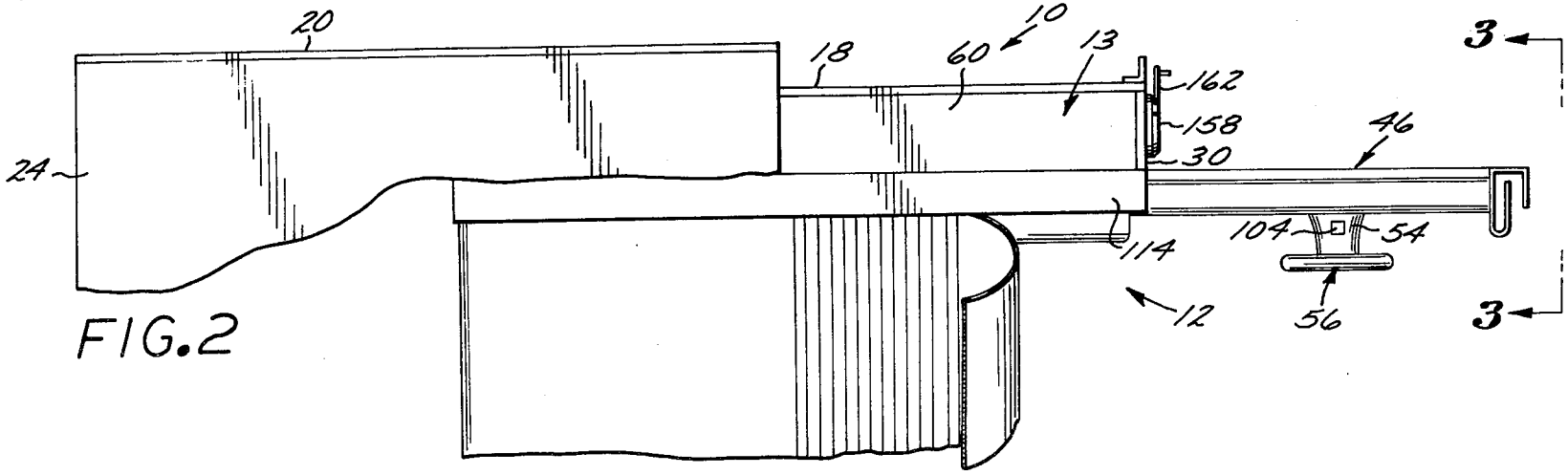
FIG. 2

TELESCOPING CLOSET

BACKGROUND OF THE INVENTION

1. Field of the Invention

The present invention relates to garment storage and display devices.

2. Description of the Prior Art

Garments have long been stored on transverse rods in closets between laterally confining walls at the open face of which closet doors are typically mounted in sliding or swinging arrangement. Garments are suspended from the transverse clothes rack by means of hangers. Garments that remain in such conventional closets become dusty after even brief periods of storage. The opening and closing of closet doors creates turbulent air currents that carry dust and lint onto clothes in the closet. Since closets are frequently used for storage of articles other than garments hanging on the clothes rack, they are difficult to clean thoroughly, Each such article must be removed, dusted and the interior of the closet must be dusted with all articles removed in order for cleaning to be thorough. As a consequence, very typically there is a considerable interval between thorough cleanings of a conventional clothes closet. As a result, clothing garments stored in conventional closets have a tendency to accumulate dust and lint quite rapidly.

To maintain garments in a dust free condition, garment bags are sometimes employed. Such garments bags may be formed with rigid or semirigid roofs and floors, and with a flexible fabric covering extending therebetween. Typical garment bags have lengthwise openings designed to face outwardly toward the open face of a closet. These openings are usually equipped with zippers which can be closed to encapsulate garments within the bag and thereby protect them from dust. However, conventional garment bags of this type hinder the removal and replacement of clothes in the closet to a considerable extent. The zippers employed frequently become jammed and inoperable. Furthermore, the zippers often become snagged in the clothing stored in the garment bags. Also, it is difficult to satisfactorily arrange clothes on hangers within a garment bag for storage since the edges of conventional garment bags at the lengthwise garment bag opening tend to collapse against the hands of an individual inserted therein. A person must therefore utilize the backs of his or her forearms and wrists to hold the flexible edges of the garment bag open. This makes it very difficult to hang clothes in the garment bags in a manner which will avoid the creation of wrinkles in the garments. Also, it is quite uncomfortable to arrange clothes while reaching with one's arms fully outstretched into a garment bag located in a closet, although this is necessary with conventional garment bags.

Other garment storage arrangements have also been proposed, but none with any great public acceptance. One such arrangement involves a hanging garment bag or closet enclosure that is positioned at the back of a stairwell The hanging garment support is mounted on a track and can be rolled forward to a door at the top of the stairwell when it is desired to withdraw or replace clothing from the hanging closet. However, manipulating clothing at the top of a stairway is quite difficult, and is also hazardous from the standpoint of safety. Furthermore, most stairwells do not provide sufficient head clearance to allow such a system to be utilized successfully.

SUMMARY OF THE INVENTION

The present invention is a telescoping closet in which a hanging wardrobe is mounted within a conventional cubicle shaped closet storage area having an open face. The open face of the closet may be covered with a swinging door that can be opened to expose the open face of the closet cubicle, if desired, although this is not necessary. The hanging wardrobe is mounted on horizontally disposed guides and can be drawn out of the closet cubicle in cantilevered suspension on elevated supports. This allows access to the cubicle for purposes of vacuuming and other cleaning operations.

The hanging wardrobe is entirely enclosed with fabric sides, a roof, and a floor to store clothes in dustproof fashion. At the upper center of the front of the hanging closet there is a crank which includes draw lines in a pulley system that pass laterally outwardly and rearward over pulleys to the rear of the hanging wardrobe. The crank can be operated to open or close draw drapes to entirely laterally encompass the enclosure defined within by the hanging wardrobe. Manipulation of the crank in one direction draws the curtains open at the center and rearwardly back along either side. Manipulation in the opposite direction draws the drapes forward and toward each other until they meet at the center of the front of the hanging wardrobe. When the drapes are open, a centrally disposed carrier can be drawn forward. Preferably, carriage tracks are reciprocally mounted on the underside thereof and a carriage is mounted on the carriage tracks and is movable longitudinally therealong. A horizontally disposed clothes rack is suspended therebeneath and may be moved into and out of the hanging wardrobe.

In the hanging wardrobe there are defined central carrier support rails above the wardrobe roof. A carrier, supported by rolling wheels reciprocally movable along these rails can be drawn forward, carrying with it the carriage tracks. A carriage, in turn, is also reciprocal along these tracks and holds the clothes rack suspended therebeneath. The carriage and carriage tracks can thereby be drawn forward and out of the hanging wardrobe, which in turn can be drawn forward and out of the closet cubicle. A composite telescoping structure is thereby formed.

When the carriage and carriage tracks are drawn forward out of the hanging wardrobe, the arrangement and smoothing of garments on hangers thereon is greatly faciliated. Moreover, when the carrier is pushed rearwardly, carrying with it the reciprocal carriage and suspended clothes rack, the garments can be stored and protected from dust and lint by the roof and floor of the hanging wardrobe and by the draperies that may be pulled therearound to form a totally enclosed volume within which the hanging garments are encapsulated.

There are four structures in the telescoping closet of the invention which are longitudinally reciprocal relative to each other. The hanging wardrobe is longitudinally reciprocal relative to the open faced closet cubicle, while the central carrier, with the carriage tracks rigidly fixed thereto, is likewise reciprocal within the upper portion of the hanging wardrobe. The carrier, with the carriage tracks affixed thereto may be moved to the rear of the hanging wardrobe so that the carriage tracks do not protrude therefrom, and so that the sections of drapes can be pulled together by means of a crank to meet at the center of the front of the hanging wardrobe. When the drapes are cranked open, on the other hand, the carrier can be pulled forward so that the carriage tracks extend forward from the hanging wardrobe in cantilevered suspension. The carriage can then be moved forward within the constraints formed by the carriage tracks to carry a clothes rod out of the hanging wardrobe. Garments can then be arranged on hangers on the clothes rod and easily smoothed and properly arranged so that wrinkles will not develop once the carrier and carriage are retracted and the garments are again retained within the confines of the hanging wardrobe.

The telescoping closet of the invention is extremely useful in protecting garments from settling dust, dirt, smoke and lint, while at the same time faciliating the cleaning of a closet and the arrangement of garments on hangers for storage in the closet. Additionally, the telescoping closet allows hanging garments to be displayed in a clearly visible fashion. It is thus quite easy to check the garments for spots or dirt to determine when cleaning is appropriate. One is thereby able to maintain the garments stored in a wardrobe in a consistently clean and attractive condition.

The telescoping closet of the invention has considerable utility in commercial retail clothing sales establishments, in addition to its residential use. In such establishments, it is extremely important for clothing to be displayed in a clearly visible and accessible fashion. The telescoping closet of the invention allows clothing to be displayed in this manner, but additionally provides a means for quickly and easily retracting the clothing garments to protect them from dust. This is highly advantageous since the evening cleaning crews of retail clothing and department stores very frequently otherwise expose the hanging garments to considerable dust and possible soiling as they clean the corridors and display showrooms with dust mops, wet mops, pails and vacuum cleaners.

The invention can be illustrated with greater clarity and particularly by reference to a specific embodiment contemplated, as illustrated in the drawing figures.

DESCRIPTION OF THE DRAWINGS

FIG. 1 is a side elevational view of the upper portion of the telescoping closet of the invention shown in a retracted condition.

FIG. 2 is a side elevational view corresponding to the view of FIG. 1 showing the closet in an extended condition.

FIG. 3 is a front elevational view of the upper portion of the closet of the invention.

DESCRIPTION OF THE EMBODIMENT

Figure 4:
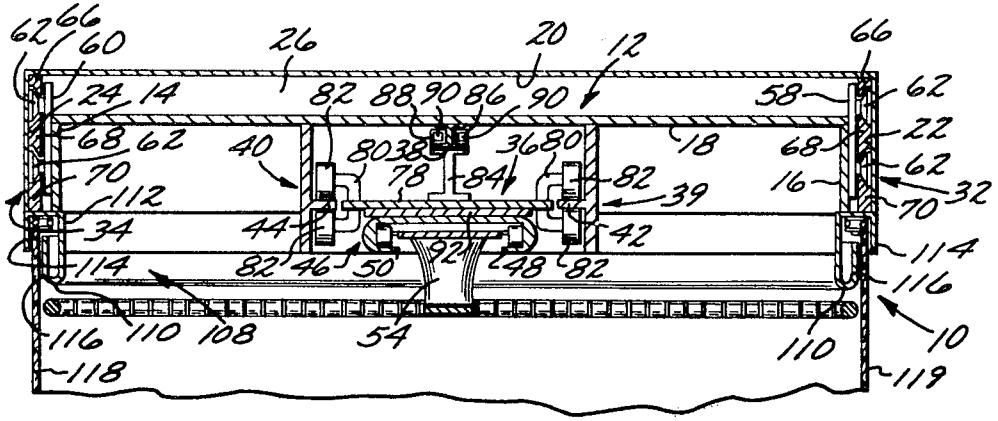
FIG. 4 is a front sectional view taken along the lines 4—4 of FIG. 1.

FIGS. 1–5 illustrates a telescoping closet 10. With reference to FIG. 4, the telescoping closet 10 is mounted within a three walled open-faced cubicle having a floor (not visible) and a ceiling 20, side walls 22 and 24 and a back wall 26. The cubicle has an open face opposite the back wall 26. While compartments of this type are generally referred to as cubicles, it is to be understood that the volume encompassed therewithin is normally in the shape of a rectangular prism.

Figure 5:
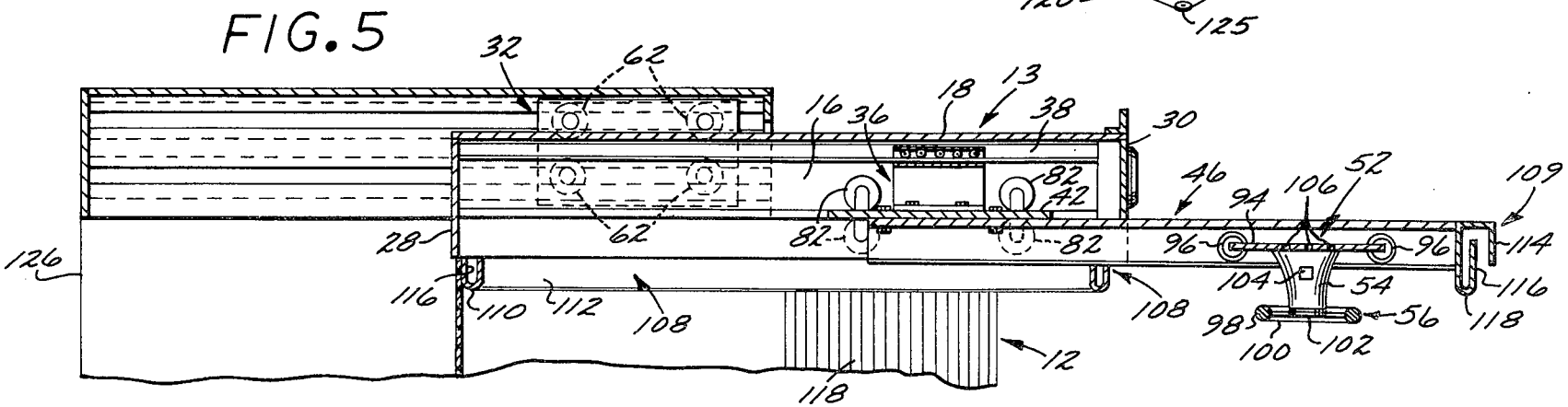
FIG. 5 is a side sectional view taken along the lines 5—5 of FIG. 3.

The telescoping closet 10 includes an enclosed hanging wardrobe 12, generally in the shape of a rectangular prism, but having a supporting framework 13 with opposing longitudinally extending vertically disposed side panels 14 and 16 running fore and aft, and an overhead, flat, horizontally disposed rectangular support panel 18 to which the side panels 14 and 16 are attached. The framework 13 also includes a transverse back panel 28 and a corresponding front panel 30. Horizontally disposed guides 32 and 34 include bevel rollers 62 interposed between elevated support rails 66–70 on the opposite closet walls 22 and 24 to carry the hanging wardrobe 12. The guides 32 and 34 allow the wardrobe 12 to be reciprocally drawn out of a closet cubicle in cantilevered suspension as depicted in FIG. 5.

A carrier 36 is reciprocally mounted to move along a central carrier support rail 38, longitudinally mounted along the underside of the support panel 18, and along T-shaped longitudinally disposed guide partitions 39 and 40, depicted in FIG. 4. The T-shaped guide partitions 39 and 40 have inwardly extending ledges 42 and 44 respectively. An elongated, channel shaped, carriage track 46 is longitudinally disposed and attached to the underside of the carrier 36. This carriage track 46 is concave downward and includes inwardly turned ears 48 and 50 which define roller surfaces upon which a wheeled carriage 52 is reciprocally mounted for longitudinal horizontal movement. The carriage 52 is equipped with a tapered truncated conical hub 54 from which a double railed oblong ring-like clothes rack 56 is suspended.

The hanging wardrobe framework 13 is generally box-shaped and opens downward and has vertically disposed, rectangular side panels 14 and 16, and transverse back and front panels, 28 and 30 respectively, all of which are connected to and braced by the overhead, horizontally disposed flat, rectangular sheet-like support panel 18. Flat, vertically oriented, longitudinally disposed rectangular roller plates 58 and 60 are fastened in contact with and immediately outside of the opposing framework side panels 14 and 16. The roller support plates 58 and 60 carry stub axles to which bevel rollers 62 are mounted, as depicted in FIGS. 4 and 5. The bevel rollers 62 are all formed with a frusto-conical geometry with their enlarged portion extending outwardly toward the opposing closet walls 22 and 24. The guides 32 and 34 include these bevel rollers 62 which are disposed for lateral entrapment within three elongated rails 66, 68 and 70 on each of the side walls 22 and 24 of the closet cubicle. The rails 66, 88 and 70 are all longitudinally disposed horizontally and parallel to each other. The rails 66, 68 and 70 include overhanging ledges that laterally entrap the bevel rollers 62 therebetween. The rollers 62 thereby cooperate with the tracks 66, 68 and 70 to carry the framework 13 in longitudinal reciprocal movement relative thereto. This allows the hanging wardrobe 12 to be reciprocally drawn into and out of the cubicle defined by the closet ceiling 20, the closet floor (not shown) and the closet walls 22, 24 and 26 which define the closet cubicle.

The carrier 36 includes a generally flat horizontally disposed rectangular plate 78 at the fore and aft ends of which and on either side are disposed yoke shaped roller mounts 80. The yoke shaped roller mounts 80 have opposing legs extending outwardly from the center of the hanging wardrobe 12 to carry right cylindrical rollers 82 in the fashion depicted in FIG. 4. The rollers 82 cooperate with the bearing ledges 42 and 44 extending inwardly from the upright T-shaped longitudinally disposed guide partitions 39 and 40. The carrier 36 includes at its center a vertically oriented longitudinally extending bearing mount 84. The bearing mount 84 has a flanged base attached to the support plate 78, at its lower extremity, and inwardly turned ears 86 and 88 at its upper extremity. The ears 86 and 88 each carry five longitudinally arranged rollers 90 mounted for rotation thereon. The rollers 90 interact with the upwardly facing bearing surfaces of the outwardly extending flanges of the I-beam shaped central carrier support rail 38. The carrier 36 thereby moves with the rotation of the rollers 82 and 90 for longitudinal reciprocation relative to the framework 13 of the hanging wardrobe 12. The weight borne by the carrier 36 bears downwardly through rollers 80 upon the upper surfaces of the bearing ledges 42 and 44, and also through rollers 90 upon the corresponding bearing ledges defined by the lower outwardly extending flanges of an I-beam shaped central carrier support rail 38.

As illustrated in FIG. 4, a reinforcing gusset 92 is fastened to the underside of the horizontal carriage support plate 78 between the plate 78 and the carriage track 46. As is apparent in FIG. 5, the carriage 52 includes a generally flat horizontally disposed plate 94 with wheels 96 mounted at the four corners thereof to support the carriage 52 in rolling movement along the roller surfaces defined by the inwardly turned ears 48 and 50 of the carriage track 46. The carriage 52 is thereby reciprocal along the carriage track 46.

The horizontally disposed clothes rack 56 is defined by an elongated looped rail 98 transversely joined at intervals by crossbars 100. At the center, the central crossbars 100 are attached to the hub 54 by a journaled ball bearing connection 102, which allows the clothes rack 56 to be rotated completely in a horizontal plane about a vertical axis defined to extend through the center of the hub 54. Preferably, the hub 54 is at least partially hollow and includes a hinged panel 104 through which deordorants or mothballs are inserted. Apertures 106 in the carriage plate 94 (FIG. 5) allow the aroma of such deodorants and pesticides to permeate the entire closet.

A drapery track 108 is disposed about the interior periphery of the framework 13, and is attached to the side walls 14 and 16, the back wall 28, and the front wall 30 of the framework 13. A section 109 of the drapery track 108 at the center of the front of the hanging wardrobe 12 is separated from the remainder and is connected transversely across the front extremity of the carriage track 46. The drapery track 108 is depicted in cross section in FIG. 4, and includes a U-shaped run 110, the innermost 112 side of which extends upwardly and outwardly and terminates in a downwardly depending skirt 114 at the outside of the hanging wardrobe 12. A gap is defined between the shorter leg 116 of the U-shaped run 110 and the skirt 114. The upper edge extremities of the draw drapes 118 and 119 move within this gap and are held therein by the drapery cord 120 of FIG. 6 sewn to the inside surface of the fabric of the upper extremities of the drapes.

The rearward movement of the drapes 118 and 119 is limited by the end mounting brackets 134 each of which includes a horizontally disposed mounting plate 132 which is curved downwardly to form a side wall 136 which extends forwardly to form a flag-shaped downwardly extending finger 138. From the mounting plate 132, the upwardly facing surface of the end bracket 134 drops downwardly in an inclined section 140, and horizontally forward in a catch plate 142 to define a forwardly horizontally extending finger 144 spaced from the vertically extending flag shaped finger 138. A U-shaped notch 146 is thereby defined between the fingers 138 and 140. When the drapery sections are pulled rearwardly, the rear extremities of the upper hem of the drapes 118 and 119 are impaled upon the fingers 138 and limited in rearward movement to the rearmost extent of the notches 146. The hems of the drapes can therefore not be drawn into the pulley system and become snagged therein. The fingers 138 and 144 thereby define the rear limits of movement of the drapes 118 and 119.

Figure 7:
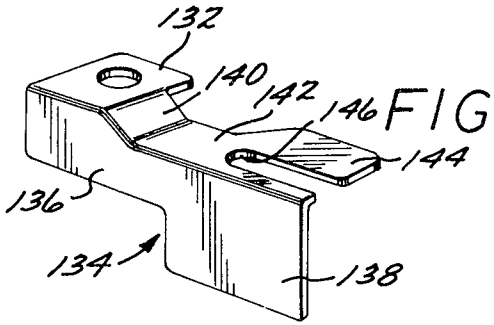
FIG. 7 is a detail view of an end bracket adapted to receive the drapes of the invention.
Figure 6:
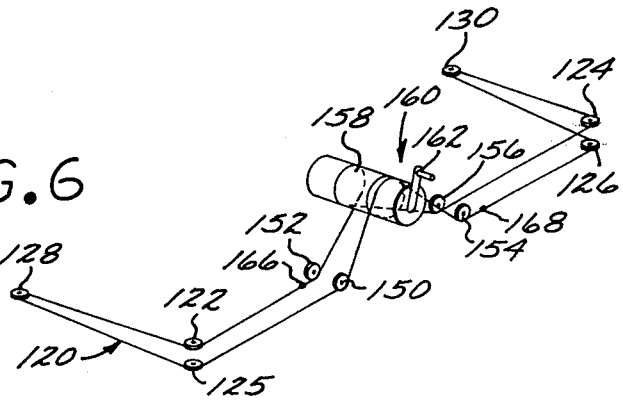
FIG. 6 is a detail view of the crank, pulley and cord system for operating the drapes of the invention.

A drapery draw system is illustrated in FIG. 6, and includes the drapery cord 120, formed into an endless loop and extending across the front of the hanging wardrobe 12 to outer pulleys 122, 124 and 126, 125, and rearwardly along the sides of the hanging wardrobe 12 to pulleys 128 and 130. The pulleys 128 and 130 are mounted about vertical axes upon the horizontal mounting plates 132 of the end brackets 134, illustrated in FIG. 7. The drapery cord 120 passes from the pulley 128 in a lower reach around the pulley 125 which is mounted coaxially with the pulley 122 for rotation about a vertical axis. From the pulley 125, the drapery cord 120 then passes transversely across the front of the hanging wardrobe 12 and about a pulley 150 which is coaxially mounted with a rearwardly displaced pulley 152 for rotation about a horizontal, longitudinally extending axis. Similar pulleys 154 and 156 are disposed on the opposite side of a winding drum 158 at the top center of the front of the hanging wardrobe 12. The drapery cord 120 passes from the pulley 150 in a loop clockwise over the drum 158 and crosses to a rearward run extending about the pulley 154 to the pulley 126. The cord then passes around the horizontally disposed pulley 130 and forwardly again to a pulley 124 coaxially mounted relative to the pulley 126 for rotation about a vertical axis. The drapery cord 120 then passes beneath the pulley 156 and then crosses in a complete loop counterclockwise about the drum 158 and then to a rearmost run into engagement with the pulleys 152, 122 and 128.

The draperies 118 and 119 are located on either side of the center of the front of the hanging wardrobe 12 and can be parted to either side by means of a crank 160, depicted in FIGS. 6, 2 and 3. The crank 160 has a crank handle 162 that can be folded over the outwardly facing end of the winding drum 158 into a slot 164 passing across the diameter thereof. The crank handle 162 can thereby be concealed within the structure of the crank drum 158. The drapes 118 and 119 are attached, respectively, to the drapery cord 120 at sewn connections 166 and 168. At these connections the drapes are also attached to mounting plates that include fingers engaged in the drapery hem and which are directed toward the center of the hanging wardrobe 12 so that the drapes 118 and 119 overlap slightly, but terminate at approximately the center of the front of the hanging wardrobe 12 in an overlapping line of enclosure. The drapes 118 and 119 can thereby be closed at the center of the front of the hanging wardrobe 12 to form a laterally encompassing enclosure.

With the carrier 36 retracted, the drapes 118 and 119 can be closed about garments hanging on the clothes rod 56. When the crank handle 162 is turned clockwise, as viewed in FIG. 6, the drape attachments 166 and 168 are drawn apart and pass laterally outwardly, carrying the drapes 118 and 119 respectively along. The drapes 118 and 119, pass with the attachment connections 166 and 168 around the pulleys 122 and 126 and rearward toward the pulleys 128 and 130. As previously noted, the limit of rearward movement of the drapes 118 and 119 is defined by the end brackets 134, and the crank 162 can no longer be turned any further clockwise once the fabric material of the drapes 118 and 119 has gathered tightly immediately forward of the pulleys 128 and 130. The carriage track 46 can then be drawn forward, with the section 109 of the drapery track 108 passing between the pulleys 150, 152 and the pulleys 154, 156.

In contrast, counterclockwise rotation of the crank handle 162 will draw the fastening connections 166 and 168 of the drapery cord 120 from positions between the pulleys 122 and 128, on the left, and 126 and 130, on the right, forwardly toward the center of the hanging wardrobe 12 so that the edges of the drapes 118 and 119 meet in overlapping fashion. The draperies 118 and 119, together with the roof 18 of the hanging wardrobe 12, and the floor thereof (not shown) form a totally enclosed volume within the hanging wardrobe 12 to encapsulate garments hung on the clothes rack 56 therein to protect such garments from dust and room odors.

When garments are stored, the carriage 52 and carrier 36 are both moved rearwardly to a position beneath the framework 13 of the hanging wardrobe 12. The drapes 118 and 119 are then drawn from their rearward positions along the sides of the hanging wardrobe 12 slightly forward of the pulleys 128 and 130, forwardly and across the front of the hanging wardrobe 12 where they meet and overlap slightly. In this connection, the drapes 118 and 119 pass within the gap defined between the skirt 114 and the leg 116 of the U-shape run 110 of the drapery track 108.

With the framework 13 drawn forwardly in the position of FIG. 5, the hanging wardrobe 12 is longitudinally displaced from the cubicle in which it is mounted, through the open face thereof. The cubicle is then accessible for vacuuming and other cleaning chores. The framework 13 can be pushed rearwardly so that the bevel rollers 62 travel rearwardly along the longitudinal tracks 66, 68 and 70 until the rear plate 28 of the framework 13 abuts the back wall 26 of the closet cubicle. The telescoping closet 10 is thereby completely retracted to the position of FIG. 1.

A reverse procedure is utilized to expand the telescoping closet. That is, the framework 13 can be drawn forwardly so that the bevel rollers 62 travel forwardly in the tracks 66, 68 and 70. Rotation of the crank handle 162 in a clockwise direction will withdraw the drapes 118 and 119 outwardly from the center of the hanging wardrobe 12, around the pulleys 122 and 126, respectively, and rearwardly along the sides of the hanging wardrobe 112. The clothes rack 56 is thereby exposed and can be drawn forwardly, bringing the carriage 52 forward as well. When the carriage 52 travels into abutment with the backside of the transverse forward section 109 of the drapery track 108, the carrier 36 will likewise be drawn forwardly so that the carriage track 46 extends outwardly, holding the clothes rack 56 depending from the carriage 52 in an extended, cantilevered fashion. In this position, garments on the rack 56 are easily arranged and quite visible for display purposes. The rack 56 can be rotated about the hub 54 to further facilitate display.

It must be understood that variations of the invention will undoubtedly become readily apparent to those familiar with clothing storage and display arrangements. Accordingly, the scope of the invention is not limited to the specific embodiment depicted, but rather is defined in the claims appended hereto.

I claim:

1. A telescoping closet for mounting in a three walled, open faced cubicle comprising:

an enclosed hanging wardrobe having an upper portion, a front, and sides, and suspended from elevated supports located on walls of said cubicle on either side of the open face thereof, said wardrobe including a drapery track extending about said upper portion at the front and sides thereof, a pair of openable draw drapes located on either side of the center of the front of said hanging wardrobe and closeable at the center of the front of said hanging wardrobe to form a laterally encompassing enclosure, and drapery draw means for drawing said drapes together at the front of said wardrobe and for alternatively pulling said drapes apart rearwardly along the sides of said hanging wardrobe to expose the front thereof, horizontally disposed guide means interposed between said elevated supports and said hanging wardrobe to allow said hanging wardrobe to be reciprocally drawn out of said cubical in cantilevered suspension on said elevated supports, a carrier mounted on the upper portion of said hanging wardrobe for horizontal reciprocal movement relative thereto, a carriage track mounted beneath and extending forwardly from said carrier and reciprocally moveable relative to said hanging wardrobe when said draw drapes are opened, a carriage mounted for reciprocal movement along said carriage track, and a horizontally disposed clothes rack suspended from said carriage for movement into and out of said hanging wardrobe.

2. A telescoping closet according to claim 1 further characterized in that said hanging wardrobe is equipped with upper and lower horizontally disposed end closures which cooperate with said draw drapes to form a totally enclosed volume within said hanging wardrobe to encapsulate garments hung on said clothes rack therein when said carrier is retracted and said drapes are drawn closed, and said drapery draw means comprises a pulley system through which a cord passes in an endless loop, and the leading edges of each of said drapes are firmly connected to specific locations on said cord, and further comprising a crank with a foldable crank handle located at the top center of the front of said hanging wardrobe, and operably coupled to said cord to open and close said drapes.

3. A telescoping closet according to claim 2 further comprising end brackets located at the upper rear of both sides of said hanging wardrobe, and pulleys of said pulley system are mounted thereon, and forwardly thereof horizontal fingers extend forward to define rear limits of movement of said drapes.

4. A telescoping closet according to claim 1 further characterized in that said drapery tracks are of a cross section defining an inner shield and an outwardly spaced downwardly depending skirt with a gap, therebetween, whereby said draw drapes move within said gap.

5. A telescoping closet for mounting in a three walled, opened faced cubicle comprising;

an enclosed hanging wardrobe suspended from elevated supports including horizontal forwardly extending rails with overhanging ledges located on the walls of said cubicle on either side of the open face thereof, said hanging wardrobe including, a framework having opposing vertically disposed side panels and an overhead, horizontally disposed support panel joining said side panels, horizontally disposed guide means interposed between said elevated supports and said hanging wardrobe to allow said hanging wardrobe to be reciprocally drawn out of said cubicle in cantilevered suspension on said elevated supports, said guide means comprising sets of bevel rollers rotatably mounted on said side panels of said framework on either side of said hanging wardrobe and entrapped by said ledges of said elevated supports, longitudinally disposed guideways secured to said framework at the center thereof, a carrier mounted on the upper portion of said hanging wardrobe and supported by said longitudinally disposed guideways for horizontal reciprocal movement therealong, carriage tracks fixedly mounted on said carrier, a carriage mounted for reciprocal movement along said carriage tracks, and a horizontally disposed clothes rack suspended from said carriage for movement into and out of said hanging wardrobe.

6. A telescoping closet for mounting in a three walled open faced cubicle comprising:

an enclosed hanging wardrobe suspended from elevated supports located on walls of said cubicle on either side of the open face thereof, said elevated supports including horizontal forwardly extending rails with overhanging ledges, said hanging wardrobe including a framework with a central carrier support rail having flanges defining upwardly facing bearing surfaces and ledges disposed equidistant from and on opposite sides of said carrier support rail and including at least one upwardly facing bearing surface, horizontally disposed guide means interposed between said elevated supports and said hanging wardrobe to allow said hanging wardrobe to be reciprocally drawn out of said cubicle in cantilevered suspension on said elevated supports, including sets of beveled rollers rotatably mounted on either side of said hanging wardrobe and entrapped by said overhanging ledges of said elevated supports, a carrier equipped with rollers that roll along said upwardly facing bearing surfaces in said framework, a carriage track mounted on the underside of said carrier, and a carriage reciprocally mounted along said carriage track, and a horizontally disposed clothes rack suspended from said carriage for movement into and out of said hanging wardrobe.

7. A telescoping closet according to claim 6 further characterized in that said clothes rack is suspended from said carriage by means of a hub, and is mounted for rotation relative to said hub.

8. A telescoping closet according to claim 7 further characterized in that said hub is at least partially hollow.

* * * * *